US006487730B2

(12) United States Patent
Pardo et al.

(10) Patent No.: US 6,487,730 B2
(45) Date of Patent: Dec. 3, 2002

(54) ANTI-SPLASH GUARD

(76) Inventors: Gerardo R. Pardo, 23912 Nine Cir., Land 'O Lakes, FL (US) 34639; Alberto J. Pardo, 908 Hillary Cir., Lutz, FL (US) 33549

( * ) Notice: Subject to any disclaimer, the term of this patent is extended or adjusted under 35 U.S.C. 154(b) by 47 days.

(21) Appl. No.: 09/738,739

(22) Filed: Dec. 15, 2000

(65) Prior Publication Data

US 2002/0152547 A1 Oct. 24, 2002

(51) Int. Cl.[7] ..... E03D 9/00
(52) U.S. Cl. ..... 4/300.3; 4/255.01
(58) Field of Search ..... 4/300.3, 253, 255.01, 4/255.05, 255.11, 255.12, 245.5

(56) References Cited

U.S. PATENT DOCUMENTS 3,858,418 A * 1/1975 Butler ..... 4/300.3
4,458,368 A * 7/1984 Webb ..... 4/300.3
4,589,149 A * 5/1986 Bassi ..... 4/245.5
4,831,669 A * 5/1989 Edwards
4,922,555 A * 5/1990 Bonilla et al. ..... 4/300.3
5,099,527 A * 3/1992 Roose ..... 4/255.11
D341,414 S * 11/1993 Baker
5,706,528 A * 1/1998 Broback ..... 4/253
5,860,170 A * 1/1999 Witt ..... 4/300.3

* cited by examiner

*Primary Examiner*—Charles R. Eloshway
(74) *Attorney, Agent, or Firm*—Arthur W. Fisher, III

(57) ABSTRACT

An anti-splash guard to enclose the open upper portion of a toilet bowl to prevent liquid and matter splashing from the interior thereof when attempting to unclog or dislodge debris from the plumbing when using a plunger including an upper elongated handle and a lower plunger member, the anti-splash guard comprising a cover with or without an upper opening to receive a portion of the upper elongated handle therethrough and a lower opening to receive a portion of the toilet bowl such that when the anti-splash guard is operatively mounted on the toilet with the lower plunger member disposed therein liquid and matter is prevented from splashing therefrom when the plunger is used to dislodge debris from the plumbing.

3 Claims, 3 Drawing Sheets

ANTI-SPLASH GUARD

BACKGROUND OF THE INVENTION

1. Field of the Invention

An anti-splash guard to enclose the open upper portion of a toilet bowl to prevent liquid splashing from the interior thereof when attempting to unclog or dislodge debris from the plumbing when using a plunger.

2. Description of the Prior Art

Plungers or plumber's helpers are well known for use to unclog a toilet or associated plumbing. Such plungers normally have a concave hemispherical rubber cup with handle attached. Manual reciprocation of the handle alternately compresses and expands the rubber cup, alternating applying pressure and suction to an obstructed fluid flow line thereby clearing the line. The plunger works best when operated vigoriously, which increases the chances for splashing, often directed at the operator.

Numerous devices have been developed to reduce the splashing of liquids, including water, from toilet bowls during operation of such plungers.

U.S. Pat. No. 4,458,368 teaches a device for clearing obstructed soil pipes without splashing water from a sink or toilet bowl comprising an elongate handle having a plunger member at a lower end and an anti-splash shield having a central passage to receive the elongate handle.

U.S. Pat. No. 5,860,170 describes a shield to prevent water from splashing from a toilet bowl when using a plunger in attempting to unplug a clogged toilet or toilet drain comprising a resilient single piece having an outer rim and a flat portion providing a positioning surface against the upper rim of a toilet bowl and a central portion dome shaped concave surface. An aperture is positioned centrally in the dome with the aperture accepting the handle of a toilet plunger forming a frustrum or truncated conical passage way for the toilet handle extending downwardly from the dome.

U.S. Pat. No. 5,706,528 shows a system for containing the splashing produced when using a toilet plunger to unclog a flush toilet comprising a substantially flat stiff splash plate to cover the upper opening of a toilet bowl when the plate is rested on the toilet bowl rim. The plate has a central aperture for a plunger handle to freely pass through.

U.S. Pat. No. 5,099,527 discloses a splash deflector for plungers for deflecting splashes having a disc with a circumferential lip on one side thereof. A plurality of stiffening ribs and anti-tearing ribs and openings may be provided on the disc. The disc is positioned on a handle and attached thereto via flaps formed by selectively slitting the disc.

U.S. Pat. No. 5,067,185 describes a toilet bowl protector which fits as a skirt around a toilet bowl comprising a flexible water-proof sheet to cover the exterior surfaces of a toilet bowl and a hole in the central area thereof and an attachment means for enabling the periphery around the hole to be releasably attached to the upper rim of the toilet bowl.

U.S. Pat. No. 4,922,555 teaches a commode plunging shield apparatus including a convex shield formed with a planar lower rim in confronting relationship to a complimentary configured commode rim surface to position the shield in overlying relationship to the commode. An aperture through the crown of an uppermost surface of the commode in alignment with the commode drain pipe slidingly receives a commode plunger therethrough to align the plunger with the commode drain and directs splashing water interiorly of the concave interior surface of the shield to contain such water within the shield and the interior of the commode.

U.S. Pat. No. 4,831,669 shows a splash guard for a toilet bowl to prevent water from splashing out of the toilet bowl when unclogging the toilet by the use of a plunger comprising a flat plate to cover the open upper end of the toilet bowl including a flexible central diaphragm provided with an opening to receive and allow movement of a plunger handle whereby vertical movement of the plunger will not result in water splashing out of the open upper end of the toilet bowl.

U.S. Pat. No. 3,408,661 discloses a decorative cover for a toilet bowl having a top opening including two pieces, a first elongated flexible band having adhesive material on its opposite sides and a unit consisting of a second elongated flexible band having adhesive material only on one side thereof and carrying a skirt for covering the toilet bowl when the skirt and band unit is applied to the edge of the toilet bowl.

Additional examples of prior part are found in U.S. Pat. No. 3,208,092; U.S. Pat. No. 3,085,611; and U.S. Pat. No. Des. 341,414.

SUMMARY OF THE INVENTION

The present invention relates to an anti-splash guard to enclose the open portion of a toilet bowl to prevent liquid and matter from splashing therefrom when attempting to unclog or dislodge debris when using a plunger. The plunger comprises an upper handle and a lower plunger member.

The anti-splash guard comprises a cover including an upper opening with a handle seal disposed adjacent thereto and a lower opening with a bowl seal disposed adjacent thereto.

The cover comprises a membrane or pliable canopy; while, the handle seal and the bowl seal each comprises a resilient or elastic ring-like or continuous element.

In use, the upper handle is passed through the upper opening with the handle seal sealing the periphery of the upper opening against the upper handle such that the lower plunger member is disposed beneath the membrane or pliable canopy. So assembled, the lower plunger member and the lower portion of the upper handle are placed into the interior of the toilet bowl.

With the anti-splash guard and the plunger so positioned relative to the toilet bowl the bowl seal is placed against the outer surface of the toilet bowl the rim and the toilet seat to seal the lower opening with the upper portion of the toilet bowl and around the toilet seat. The anti-splash guard may be used with the seat in either the up or down position with equal performance.

With lower plunger member placed over the lower portion of the toilet or associated plumbing, the upper handle of the plunger is vigorously moved up and down to dislodge or unclog debris from the lower portion of the toilet or associated plumbing with the membrane or pliable canopy of the anti-splash guard preventing liquid or matter from splashing from the interior of the toilet bowl.

When the process is complete, the toilet is flushed with the anti-splash guard in place to assist in containing any liquid or matter overflow if plunging is unsuccessful.

Then the anti-splash guard and the plunger are removed from the toilet bowl. Finally, the anti-splash guard is removed from the upper elongated handle and disposed of.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
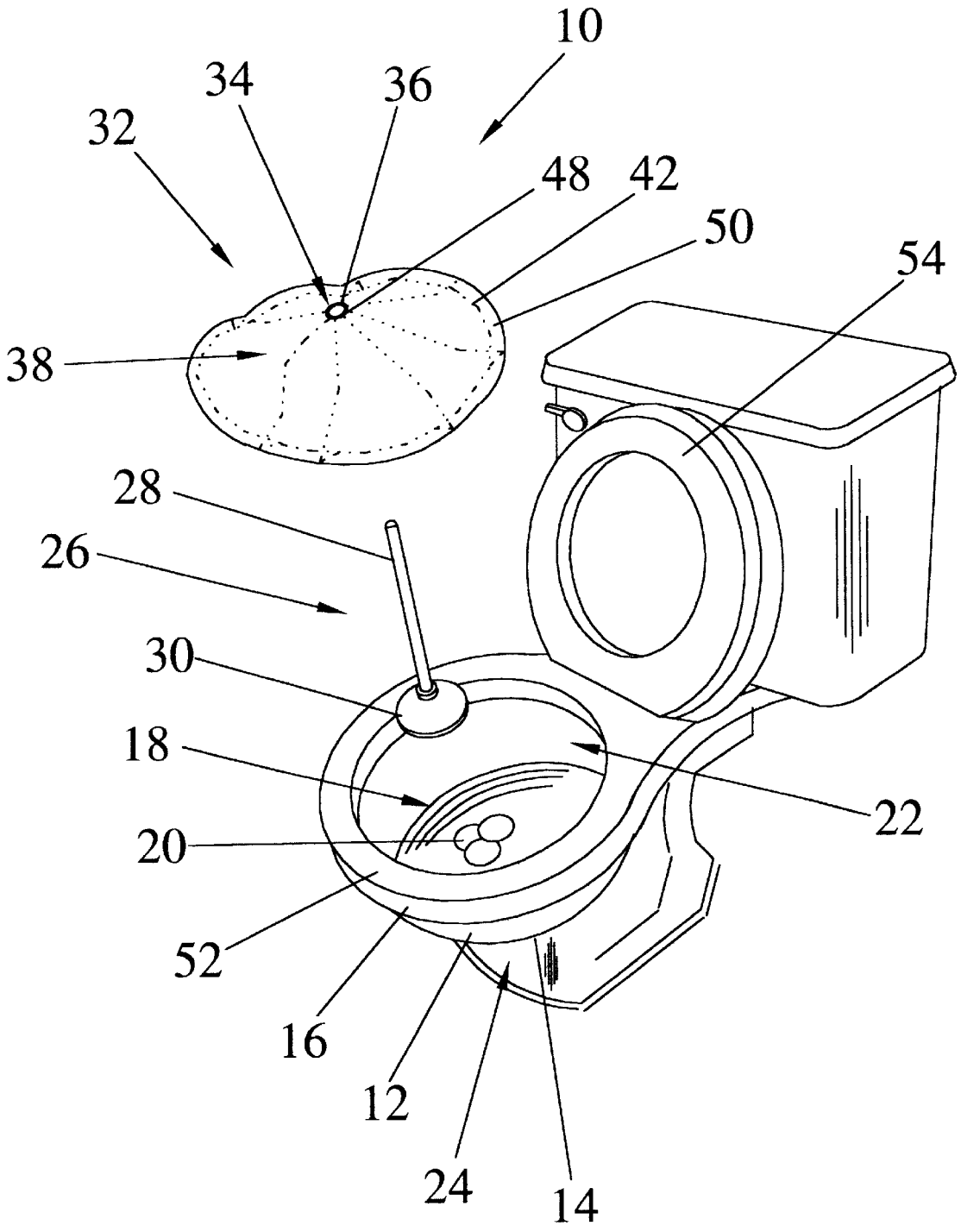
FIG. 1 is a perspective exploded view of the anti-splash guard of the present invention in combination with a plunger and toilet.
Figure 2:
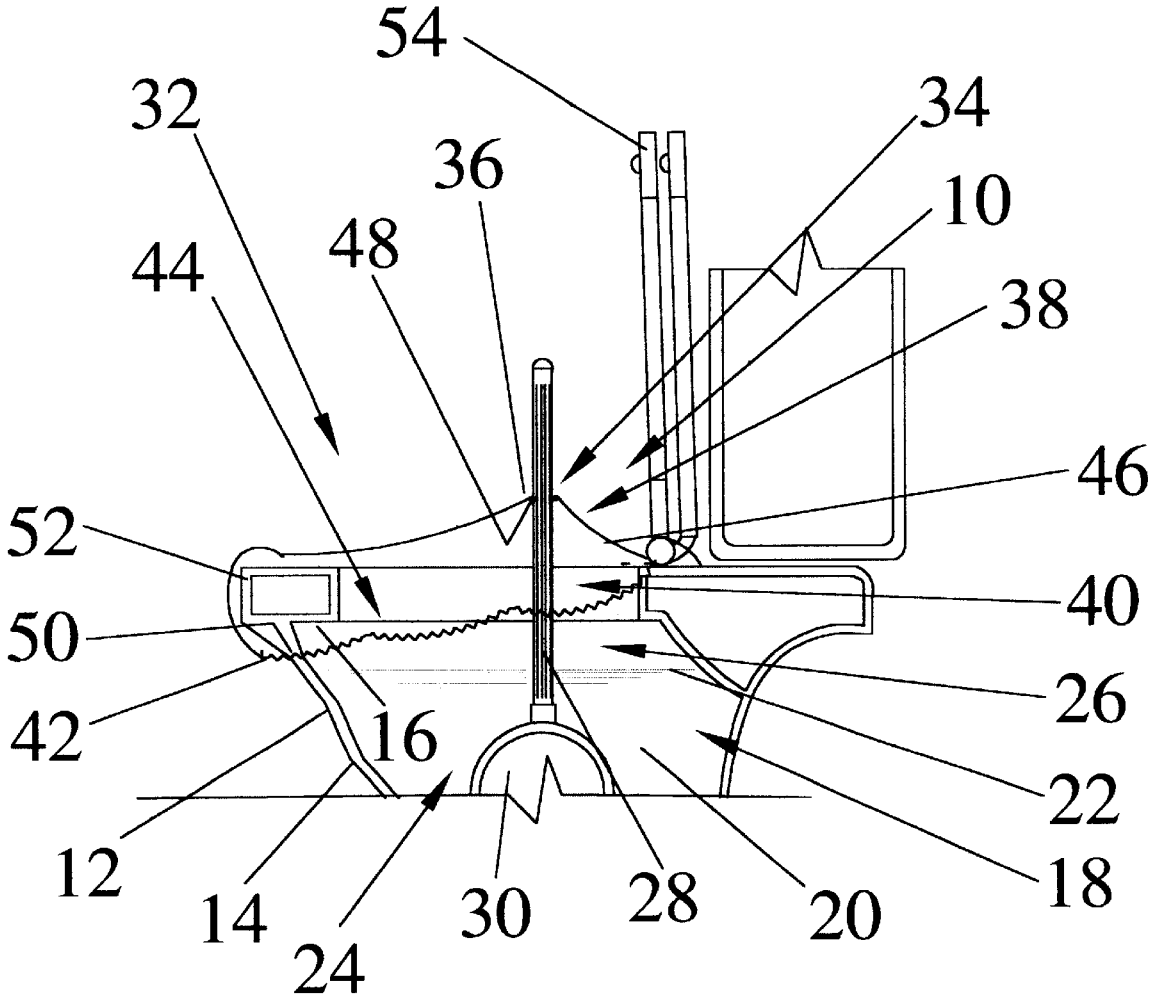
FIG. 2 is a cross-sectional side view of the anti-splash guard of the present invention in combination with a plunger and toilet.

As shown in FIGS. 1 and 2, the present invention relates to an anti-splash guard generally indicated as 10 to enclose the open upper end portion 12 of a toilet bowl 14 adjacent the rim 16 thereof to prevent liquid 18 and matter 20 from splashing from the interior 22 thereof when attempting to unclog or dislodge debris (not shown) from the lower portion of the toilet or associated plumbing generally indicated as 24 when using a plunger generally indicated as 26. The plunger 26 comprises an upper elongated handle 28 and a hemispherical lower plunger member or concave cup 30.

The anti-splash guard 10 comprises a cover generally indicated as 32 including a centrally disposed upper minor opening 34 having a periphery 36 with a handle seal generally indicated as 38 disposed adjacent thereto and a lower major opening 40 having a periphery 42 with a bowl seal generally indicated as 44 disposed adjacent thereto.

The cover 32 comprises a membrane or pliable canopy 46; while, the handle seal 38 and the bowl seal 44 comprise a first resilient or elastic ring-like or continuous element 48 and a second resilient or elastic ring-like or continuous element 50 respectively.

In use, the upper elongated handle 28 of the plunger 26 is passed through the centrally disposed upper minor opening 34 with the first resilient or elastic ring-like or continuous element 48 sealing the periphery 36 of the centrally disposed upper minor opening 34 against the upper elongated handle 28 of the plunger 26 such that the lower plunger member or concave cup 30 is disposed beneath the membrane or pliable canopy 46 of the cover 32. So assembled, the lower plunger member or concave cup 26 and the lower portion of the upper elongated handle 28 are placed into the interior 22 of the toilet bowl 14.

With the anti-splash guard 10 and the plunger 26 so positioned relative to the toilet bowl 14, the second resilient or elastic ring-like or continuous element 50 is placed against the outer surface 52 of the upper portion 12 of the toilet bowl 14 below the rim 14 and the toilet seat 54 to seal the periphery 42 of the lower major opening 40 with the upper portion 12 of the toilet bowl 14 and around the toilet seat 54.

With lower plunger member or concave cup 30 of the plunger 26 placed over the lower portion of the toilet or associated plumbing 24, the upper elongated handle 28 of the plunger 26 is vigorously moved up and down to dislodge or unclog debris from the lower portion of the toilet or associated plumbing 24 with the membrane or pliable canopy 46 of the cover 32 of the anti-splash guard 10 preventing liquid 18 or matter 20 from splashing from the interior 22 of the toilet bowl 14.

When the process is complete, the anti-splash guard 10 and the plunger 26 are removed from the toilet bowl 14. The anti-splash guard 10 is removed from the upper elongated handle 28 and disposed of.

Figure 3:
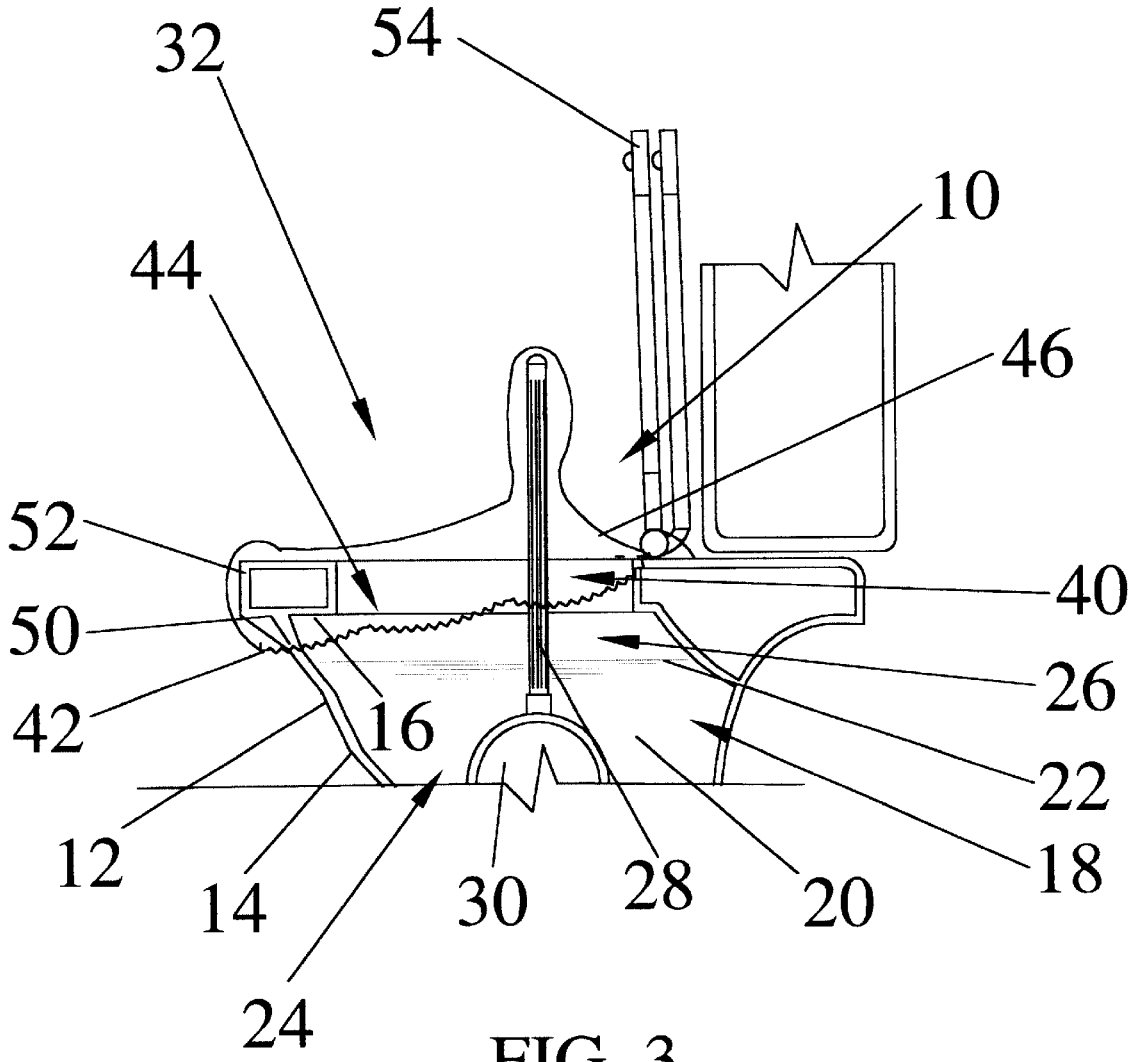
FIG. 3 is a cross-sectional side view of an alternate embodiment of the anti-splash guard of the present invention in combination with a plunger and toilet.

FIG. 3 shows an alternate embodiment of the anti-splash guard 10 with similar structural elements similarly designated. Specifically, the anti-splash guard 10 comprises a cover generally indicated as 32 including a lower major opening 40 having a periphery 42 with a bowl seal generally indicated 44 disposed adjacent thereto.

The cover 32 comprises a membrane or pliable canopy 46; while, the bowl seal 44 comprises a resilient or elastic ring-like or continuous element 50.

In use, the upper elongated handle 28 of the plunger 26 is at least partially disposed with the membrane or pliable canopy 46 such that the lower plunger member or concave cup 30 is disposed beneath the membrane or pliable canopy 46 of the cover 32. So assembled, the lower plunger member or concave cup 26 and the lower portion of the upper elongated handle 28 are placed into the interior 22 of the toilet bowl 14.

With the anti-splash guard 10 and the plunger 26 so positioned relative to the toilet bowl 14, the resilient or elastic ring-like or continuous element 50 is placed against the outer surface 52 of the upper portion 12 of the toilet bowl 14 below the rim 14 and the toilet seat 54 to seal the periphery 42 of the lower major opening 40 with the upper portion 12 of the toilet bowl 14 and around the toilet seat 54.

With lower plunger member or concave cup 30 of the plunger 26 placed over the lower portion of the toilet or associated plumbing 24, the upper elongated handle 28 of the plunger 26 is vigorously moved up and down to dislodge or unclog debris from the lower portion of the toilet or associated plumbing 24 with the membrane or pliable canopy 46 of the cover 32 of the anti-splash guard 10 preventing liquid 18 or matter 20 from splashing from the interior 22 of the toilet bowl 14.

When the process is complete, the anti-splash guard 10 and the plunger 26 are removed from the toilet bowl 14. The anti-splash guard 10 is removed from the upper elongated handle 28 and disposed of.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An anti-splash guard to enclose the open upper portion of a toilet bowl to prevent liquid and matter splashing from the interior thereof when attempting to unclog or dislodge debris from the plumbing when using a plunger including an upper elongated handle and a lower plunger member, said anti-splash guard comprising a cover formed from pliable material and including an upper opening to sealingly receive a portion of the upper elongated handle therethrough and a lower opening including a periphery with an elastic element disposed adjacent thereto to receive a portion of the outside surface of the toilet bowl such that when said anti-splash guard is operatively mounted on the toilet with the lower plunger member disposed therein liquid and matter is prevented from splashing therefrom when the plunger is used to dislodge debris from the plumbing, said elastic element sealing said anti-splash guard against the outside of the toilet.

2. The anti-splash guard of claim 1 wherein said cover comprises a collapsible membrane.

3. The anti-splash guard of claim 1 wherein said upper opening comprises a centrally disposed upper minor opening including a periphery with an elastic handle/seal disposed adjacent thereto.

* * * * *